US006585857B2

(12) United States Patent
Rührig

(10) Patent No.: US 6,585,857 B2
(45) **Date of Patent: *Jul. 1, 2003**

(54) METHOD OF MANUFACTURING SECURITY ELEMENTS FOR ELECTRONIC ARTICLE SURVEILLANCE AND SECURITY ELEMENT

(75) Inventor: Manfred Rührig, Weinheim (DE)

(73) Assignee: Meto International GmbH, Hirschhorn (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/399,334

(22) Filed: Sep. 20, 1999

(65) Prior Publication Data

US 2002/0127940 A1 Sep. 12, 2002

(30) Foreign Application Priority Data

Sep. 19, 1998 (DE) ..... 198 43 062

(51) Int. Cl.[7] ..... D21H 27/00

(52) U.S. Cl. ..... 162/123; 162/138; 162/140; 162/141; 162/192; 442/381

(58) Field of Search ..... 162/123, 138, 162/140, 192, 141; 442/381

(56) References Cited

U.S. PATENT DOCUMENTS

| | | | | |
|---|---|---|---|---|
| 4,114,032 A | * | 9/1978 | Brosow et al. | 235/493 |
| 5,143,583 A | * | 9/1992 | Marchessault et al. | 162/138 |
| 5,191,315 A | | 3/1993 | Cordery et al. | 340/572 |
| 5,756,220 A | * | 5/1998 | Hoshino et al. | 428/537.5 |

* cited by examiner

*Primary Examiner*—Elizabeth M. Cole

(57) ABSTRACT

The present invention is directed to a method of manufacturing security elements for electronic article surveillance, the security elements being made of at least two layers, and to a security element manufactured according to the method The method comprises the steps of applying a first layer of a cellulose material in a still moist state to a second layer of a cellulose material, with soft magnetic elements which emit a characteristic signal in the interrogating field of an article surveillance system being added to one of the two layers; and subsequently die stamping or cutting out the desired shape of the security elements from the two layers in the dry state. The method provides a low cost manufacturing means for reliably operating security elements.

7 Claims, 1 Drawing Sheet

METHOD OF MANUFACTURING SECURITY ELEMENTS FOR ELECTRONIC ARTICLE SURVEILLANCE AND SECURITY ELEMENT

FIELD OF THE INVENTION

The invention relates to a method of manufacturing security elements for electronic article surveillance, The method includes the step of making the security elements of at least two layers. The present invention also relates to a security element manufactured according to the method.

BACKGROUND OF THE INVENTION

From European patent EP 0 340 034 B1 there is known a security element for electronic article surveillance in warehouses and department stores which contains fibers of a material displaying high permeability and low coercive force. Either these fibers are contained in a paper substrate or they are affixed to the substrate by adhesive bonding. The orientation of the fibers in or on the substrate is completely arbitrary, as a result of which, there is a relatively high probability of the fibers overlapping with other fibers and coupling with them magnetically. The magnetic flux of the fibers is thereby concentrated and intensified, making it possible for the security elements described in the specification of the noted patent to be detected regardless of their orientation in relation to the interrogating field of the electronic article surveillance system.

SUMMARY OF THE INVENTION

It is an object of the present invention to provide a method for the manufacture of low cost and reliably operating security elements for electronic article surveillance.

This object is accomplished in that a first layer of a cellulose material is applied, in the still moist state, to a second layer of a cellulose material, with soft magnetic elements, which emit a characteristic signal in the interrogating field of an article surveillance system, being added to one of the two layers. The desired shape of the security elements is die stamped or cut out of the two layers in the dry state.

The advantage of the method of the present invention is to be seen mainly in the possibility for the layer with the soft magnetic fibers to be very thin because it is supported by the second thicker layer. Hence the layer with the soft magnetic fibers can be made of a highly dilute paper fiber suspension, which, as is described be hereafter in further detail, affords immense advantages as regards the subsequent orientation of the soft magnetic fibers and their processible length in the still moist cellulose material of the second layer. Furthermore, with both layers being applied to each other in the still moist state, they adhere firmly together after drying without the need of any additional steps, e.g., adhesive bonding the two layers.

According to a preferred further aspect of the method of the present invention, provision is made for the soft magnetic elements, which are fibers of very small diameter, to be oriented in essentially the longitudinal direction of the material web by external force applied when the fibers are in the moist state. In accordance with a particularly favorable embodiment of the method, this orientation is performed by providing a device, either above or underneath the layer of cellulose material containing the soft magnetic fibers, which produces a magnetic field in the longitudinal direction, meaning in the running direction of the material web.

Because at this instant the cellulose material is in a still moist state, the fibers are oriented in the running direction of the material web under the action of the magnetic field. Alternatively, an orientation of the fibers in the running direction of the material web can also be effected forcibly by accelerating the layer of cellulose material with the integrated soft magnetic fibers; this results likewise in the fibers being oriented in the longitudinal direction of the layer.

The security element for electronic article surveillance produced by this method incorporates the following features: The first layer is a cellulose material comprised of cellulose fibers. The second layer is comprised likewise of a cellulose material made up of a mixture of cellulose fibers and soft magnetic elements. These soft magnetic elements are excited, as was previously mentioned in a magnetic interrogating field of an electronic article surveillance system to emit a characteristic signal.

As previously explained in connection with the method of the present invention, the magnetic elements are fibers made of a soft magnetic material. With a view to achieving as high a detection rate as possible it has proven advantageous for the length of the soft magnetic fibers to exceed 2 cm on average.

A preferred further aspect of the security element of the present invention provides for the cellulose material of the second layer to contain no more than half as many soft magnetic fibers as cellulose fibers. The superposed arrangement of two layers of cellulose material as disclosed in the present invention permits, in particular, the concentration of cellulose fibers contained in the layer with the soft magnetic fibers to be maintained at a very low level without detracting from stability. On account of the extremely dilute fiber suspension for the second layer this preferred embodiment of the security element of the present invention allows for (a) relatively long magnetic fibers to be admixed to the cellulose material;

(b) the magnetic fibers to disperse well without excessive bending; and (c) the magnetic fibers to be easily oriented by the application of external forces if required.

The present invention will be described in more detail in the following with reference to the accompanying drawing.

DETAILED DESCRIPTION

Figure 1:
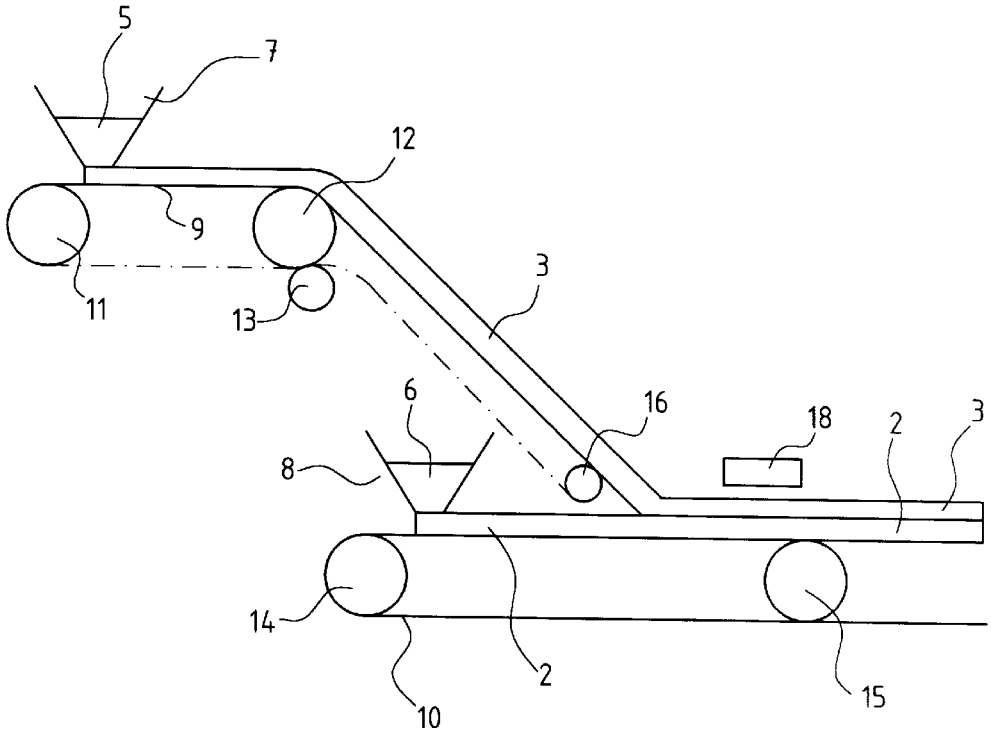
FIG. 1 is a schematic illustration of a device used for implementing the method of the present invention.

FIG. 1 is a schematic representation of a device used for implementing the method of the present invention. The cellulose material 6 is placed on a support surface 10 through a delivery device 8. The support surface 10 is, for example, a fine-meshed endless net, which is guided over reversing rollers 14, 15. Excess water can be removed from the cellulose material 6 through the mesh of the net 10.

A second amount of cellulose material 5 is placed on a second support surface 9 by means of a further delivery device 7. This support surface 9 can also be a fine-meshed endless net, which is guided over reversing rollers 11, 12, 16. Underneath the reversing roller 16 the layer 3 of cellulose material 5 is applied, while still moist, to the first layer 2 of cellulose material 6. The direction of travel of the web of material composed of the layers 2, 3 is indicated by an arrow in the drawings.

While the cellulose material 6 of the first layer 2 consists of cellulose fibers only, soft magnetic fibers 4 are mixed into the cellulose material 5 of the second layer 3. The mixing ratio is maximally 50:50. A device 18, which generates a magnetic field in the running direction of the web of material 2, 3 is arranged above the second layer 3 containing the soft magnetic fibers 4. As already previously described, the cellulose material 5 of the second layer contains only a diluted concentration of cellulose fibers. If now the still moist layer 3 is passed underneath the device 18, the soft magnetic fibers 4 have sufficient freedom of movement to orient themselves in the direction of an active magnetic field. The detection probability for the security elements 1 made from the material web 2, 3 can be considerably increased by the forced orientation of the magnetic fibers 4 in the predetermined concentration of soft magnetic fibers.

As already previously mentioned, the orientation of the soft magnetic fibers 4 can also be forced by mechanical action on the still moist cellulose material 5 containing the soft magnetic fibers 4. For example, a force component in the traveling direction of the web of material 3 can be simply achieved by accelerating the web of material 3 in the direction of travel.

Figure 2:
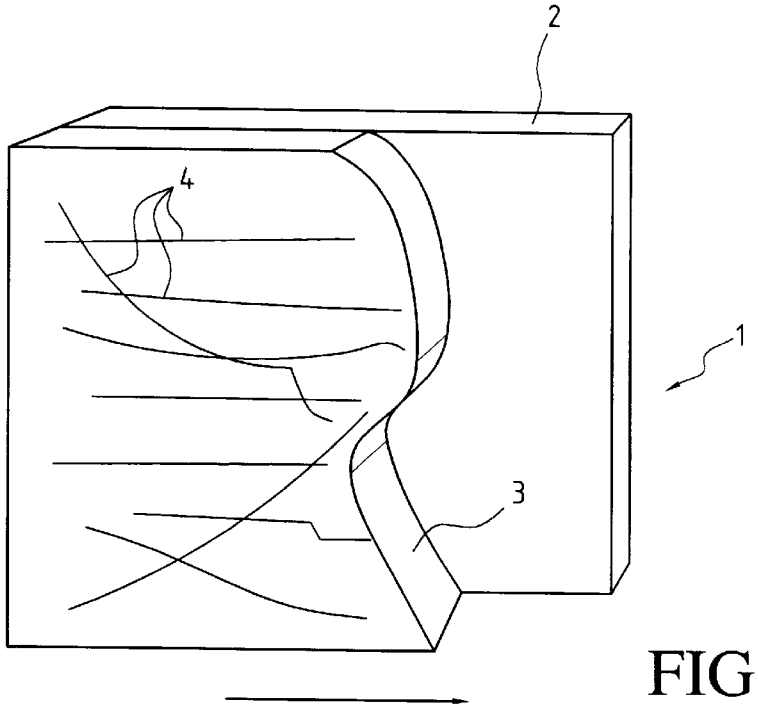
FIG. 2 is a perspective view of a security element manufactured in accordance with the method of the present invention.

FIG. 2 shows a perspective representation of a security element 1 manufactured by the method of the present invention. The security element 1 includes a first layer 2, made of a cellulose material 6 composed of cellulose fibers without any further admixtures. The second layer 3 is composed of a mixture of a cellulose material 5 to which soft magnetic fibers 4 are admixed. The length of the soft magnetic fibers 4 is calculated so that with great probability the fibers 4 will be excited in an electronic article surveillance system to emit a characteristic signal, as the result of which an alarm is activated.

According to a further aspect of the security elements 1 of the present invention, the soft magnetic fibers 4 are oriented essentially in one direction. This has the advantage of enabling the characteristic signal of the security element to be detected readily by an article surveillance system even with a small number of fibers 4 per security element 1.

The advantages of the security elements 1 produced by the method of the present invention are now reiterated by way of conclusion. By using two-ply paper for the production of the security elements 1 it is possible to maintain the concentration of cellulose fibers in the layer 3 containing the soft magnetic fibers 4 at a very low level. Consequently the concentration of soft magnetic fibers 4 can also be low, as a result of which the production costs for a security element 1 of the present invention can be minimized accordingly. A further advantage resides in the tear strength of the two-ply material web 2, 3. The layer 3 with the soft magnetic fibers 4 oriented essentially in the longitudinal direction displays an anisotropic tear strength. The tear strength is very low particularly in the direction of orientation of the fibers 4. Considering, however, that Orientation of the cellulose fibers in the first layer 2 is completely arbitrary, the material web 2, 3 as such displays the preferred isotropic tear strength. Furthermore, it is possible to use very long fibers, and the fibers remain approximately stretched throughout the production process.

What is claimed is:

1. A method of manufacturing security elements for electronic article surveillance, comprising the steps of:

producing a web of material by
providing a first layer of a cellulose material;
providing a second layer of a cellulose material;

adding fibers consisting of soft magnetic material which emit a characteristic signal in an interrogating field of an article surveillance system to one of the first and second layers of cellulose material and orienting the fibers of said soft magnetic material in essentially the longitudinal direction of said one layer;

applying the second layer to the first layer while in a still moist state to form said web of material; and shaping the security elements to a desired shape by one of: die stamping and cutting out of the web of material in a dry state.

2. The method as defined in claim 1, further comprising the step of:

applying an external force to orient the fibers of said soft magnetic material in essentially the longitudinal direction of the web of material in the moist state.

3. The method as defined in claim 2, where the external force is applied by a magnetic field acting in the longitudinal direction of the web of material or by accelerating the web of material in the direction of travel in the moist state.

4. A security element for electronic article surveillance, comprising:

a first layer of cellulose material comprised of cellulose fibers; and a second layer of cellulose material comprised of cellulose fibers in which fibers of a soft magnetic material are contained which are oriented essentially in one direction and which are excited in a magnetic interrogating field of an electronic article surveillance systems to emit a characteristics signal.

5. The security as defined in claim 4, wherein the length of the fibers of said soft magnetic material exceed a cm on average.

6. The security element as defined in claim 4, wherein said second layer contains no more than half as many fibers of said soft magnetic material as cellulose fibers.

7. The security element as defined in claim 4, wherein said second layer has a lower concentration of cellulose fibers than the cellulose material of the first layer.

* * * * *